United States Patent [19]

Lassow et al.

[11] Patent Number: 4,703,806

[45] Date of Patent: Nov. 3, 1987

[54] CERAMIC SHELL MOLD FACECOAT AND CORE COATING SYSTEMS FOR INVESTMENT CASTING OF REACTIVE METALS

[75] Inventors: Eliot S. Lassow; Paul R. Johnson, both of Whitehall; Sidney R. Whitaker, Hart; Manuel Guerra, Jr., Twin Lake, all of Mich.

[73] Assignee: Howmet Turbine Components Corporation, Greenwich, Conn.

[21] Appl. No.: 884,591

[22] Filed: Jul. 11, 1986

[51] Int. Cl.[4] ..... B22C 1/06

[52] U.S. Cl. ..... 164/518; 164/519; 164/525; 164/529; 106/38.3; 106/38.35

[58] Field of Search ..... 164/516, 517, 518, 519, 164/529, 525, 138; 106/38.35, 38.3

[56] References Cited

U.S. PATENT DOCUMENTS

| | | | |
|---|---|---|---|
| 3,148,422 | 9/1964 | Payne | 164/516 |
| 3,239,897 | 3/1966 | Lirones | 106/38.28 |
| 3,241,200 | 3/1966 | Lirones . | |
| 3,248,763 | 5/1966 | Lirones . | |
| 3,256,574 | 6/1966 | Lirones . | |
| 3,257,692 | 6/1966 | Operhall . | |
| 3,266,106 | 8/1966 | Lirones . | |
| 3,422,880 | 1/1969 | Brown et al. . | |
| 3,489,709 | 1/1970 | Halsey | 106/38.3 |
| 3,537,949 | 11/1970 | Brown et al. . | |
| 3,743,003 | 7/1973 | Brown . | |
| 3,955,616 | 5/1976 | Gigliotti et al. . | |
| 3,972,367 | 8/1976 | Gigliotti et al. . | |
| 4,014,706 | 3/1977 | Waldron . | |
| 4,031,945 | 6/1977 | Gigliotti et al. . | |
| 4,040,845 | 8/1977 | Richerson et al. . | |
| 4,043,377 | 8/1977 | Mazdiyasni | 164/517 X |
| 4,057,433 | 11/1977 | Brown . | |
| 4,063,954 | 12/1977 | Brown . | |
| 4,135,030 | 1/1979 | Basche . | |
| 4,240,828 | 12/1980 | Huseby . | |
| 4,415,673 | 11/1983 | Feagin . | |
| 4,504,591 | 3/1985 | Feagin . | |
| 4,578,487 | 3/1986 | Barfurth et al. | 556/40 |

FOREIGN PATENT DOCUMENTS

| | | | |
|---|---|---|---|
| 530731 | 3/1977 | U.S.S.R. | 164/518 |

OTHER PUBLICATIONS

L. J. Poinke et al., "Manufacturing Technology for Large Titanium Inlet Castings," AFWAL/MLTM Report No. IR-163-0(1), Apr. 1981.

E. D. Calvert, "An Investment Mold for Titanium Casting," Bureau of Mines, RI 8541, 1981.

D. R. Schuyler et al., "Investment Casting of Low--Melting Titanium Alloys," in Vacuum Metallurgy, R. C. Krutenat (ed.), Science Press, Princeton, 1977.

R. C. Feagin, "Casting of Reactive Metals into Ceramic Molds," Sixth World Conference on Investment Casting, Washington, D.C., 1984.

S. J. Schwedt et al., "Manufacturing Technology for Large Titanium Inlet Castings," AFWAL/MLTM Report No. IR-163-0(3), Apr. 1982.

C. E. Holcombe et al., "Consideration of Yttria for Vacuum Induction Melting of Titanium," Metallurgical Transactions B, vol. 14B, Sep. 1983, pp. 497-499.

Stauffer Chemical Company, Technical Information Bulletin regarding SILBOND ® H-6.

The Dow Chemical Company, and Arco Chemical Company brochures regarding Propylene Glycol Methyl Ether.

S. R. Lyon et al., "The Interaction of Titanium with Refractory Oxides," Titanium Science and Technology, vol. 1, edited by R. I. and H. M. Burte, Plenum Press, New York, 1978, pp. 271-284.

R. L. Helferich et al., "An Investigation of Yttrium Oxide as a Crucible Material for Melting Titanium," NSRDC Report 3911, Jan. 1973.

B. C. Weber et al., "Ceramic Crucible for Melting Titanium," Journal of the American Ceramic Society, vol. 40, No. 11, 1957, pp. 363-373.

C. A. Alexander et al., "Evaluation of Refractory Oxide Crucible Materials for Induction Melting of Titanium," Research on Metallurgical Synthesis, AFML-TR-7-2-238, Task III, Dec. 1972.

D. A. Schuyler et al., "Development of Titanium Alloy Casting Technology," AFML-TR-76-80, Aug. 1976, pp. 275-279.

*Primary Examiner*—Kuang Y. Lin

*Attorney, Agent, or Firm*—Finnegan, Henderson, Farabow, Garrett & Dunner

[57] ABSTRACT

An yttria-based slurry comprising a dense grain yttria powder and a non-aqueous-based binder is used as a mold facecoat and corecoat for investment casting of reactive metals such as titanium and titanium alloys.

24 Claims, No Drawings

CERAMIC SHELL MOLD FACECOAT AND CORE COATING SYSTEMS FOR INVESTMENT CASTING OF REACTIVE METALS

BACKGROUND OF THE INVENTION

The present invention relates to mold facecoats and corecoats for use in the fabrication of molds for casting reactive metals, particularly complex shapes thereof.

Melting and investment casting of reactive metals, such as titanium or titanium alloy, is made difficult due to the reactive metal's affinity for elements such as oxygen, nitrogen and carbon. At elevated temperatures, the reactive metals tend to react with almost any type of containment incorporating such elements. For example, at elevated temperatures during investment casting, solidification and cooling, a Ti-6Al-4V alloy reacts with oxygen and/or most oxide ceramics to form an oxygen enriched surface layer. This surface layer, commonly referred to as an "alpha-case" or a "coarse basket weave," can be brittle and is therefore detrimental to the mechanical properties of the casting and thus must be removed.

Typically, removal of oxygen or interstitial element enriched surface material is accomplished by mechanical or chemical means such as chemical milling in an acid bath. This process, however, is not straightforward, since the thickness of the alpha-case on an as-cast component varies for each section of the component depending on the thickness and solidification rate of the section. On the other hand, chemical milling removes surface material at an essentially uniform rate regardless of the section's thickness. Consequently, numerous iterations may be necessary to determine the proper wax pattern die size which must be utilized to generate a chemically milled component having the required finished product dimensions.

In investment casting, mold/metal reactivity traditionally has been reduced or eliminated by using facecoat or corecoat materials such as carbon or graphite, high temperature oxides, refractory metals, halide salts or the reactive metals themselves. These traditional containment methods usually are expensive, complex or even potentially hazardous such as when radioactive materials such as $ThO_2$ are used as the facecoat or corecoat material. In addition, these traditional facecoat and corecoat materials present the following technical limitations: (1) they are often difficult to apply; (2) they often require controlled atmosphere firing and pre-heating; (3) even with these materials there can still be a substantial risk of contamination from mold materials; and (4) the castings produced generally exhibit a substantial section thickness dependent reaction layer which must be removed, thereby causing difficulty in determining the as-cast part size necessary to produce the finished part.

For a number of years, yttria ($Y_2O_3$) has been investigated as a possible mold facecoat material because of its low reactivity with respect to titanium. To make application of yttria economical, investigators have tried yttria-based slurries. Heretofore, however, investigators have been unsuccessful in using yttria-based slurries as mold facecoat materials in the fabrication of molds for casting reactive metals.

For example in 1976, Schuyler et al. reported the results of tests using fine particle yttria dispersed in colloidal potassium silicate solution to which coarse yttria has been added as a mold facecoat material. D. R. Schuyler, et al., "Development of Titanium Alloy Casting Technology," AFML-TR-76-80, August 1976, pp. 275–279. The molds made with this facecoat material were not satisfactory. Schuyler et al. reported that "the facecoat was not as smooth as normal for the standard foundry system. Pores and pits were present, and the stucco showed through in many places." Schuyler et al. also tried a slurry containing yttria, titania and colloidal silica. Schuyler et al. found that with this system the facecoat surface was even more highly pitted.

Further unsuccessful attempts to use an yttria-based slurry as a mold facecoat material were reported by Calvert in 1981. E. D. Calvert, "An Investment Mold for Titanium Casting," Bureau of Mines, RI8541, pp. 5–7, 1981. Calvert reported that mold facecoat compositions comprising yttria powder and aqueous colloidal silica binder resulted in slurries which exhibited rapid and premature gellation and also resulted in mold surfaces which exhibited a tendency to crack and spall during mold firing. Similar results were obtained with yttria-based slurries comprising yttria powder and a zirconium acetate binder. Calvert also tried adding $H_2SO_4$ to the yttria-based slurry but this caused porosity in the resulting titanium investment casting.

SUMMARY OF THE INVENTION

It is, therefore, a main object of the present invention to provide a mold facecoat or corecoat material for the fabrication of molds for the casting of reactive metals which overcomes the above-mentioned drawbacks.

It is a more specific object of the present invention to provide an yttria-based slurry which can be used as a mold facecoat or corecoat material for the fabrication of molds for casting reactive metals.

A further object of this invention is to provide a mold facecoat or corecoat material for use in the fabrication of molds for casting reactive metals which reduces or eliminates reactivity between the mold and the reactive metal.

Another object of this invention is to provide an yttria based slurry mold facecoat which can be applied smoothly and evenly to the wax pattern used in the lost wax process for fabricating casting shells for casting reactive metals.

A still further object of this invention is to provide an yttria-based slurry corecoat which can be applied relatively smoothly and evenly to a ceramic core in the fabrication of a casting core for casting hollow parts from reactive metals.

An additional object of this invention is to provide a method of producing high precision investment castings of reactive metals in large, small, or intricate shapes which were unobtainable with previous mold facecoats and corecoats.

A further object of this invention is to provide a method for producing high precision investment castings of reactive metals at a lower cost than previous techniques.

A still further object of this invention is to reduce the amount of chemical milling required to produce high precision investment castings of reactive metals.

Another object of this invention is to reduce or eliminate the surface reaction layer (alpha-case) formed by the reaction between the mold and the reactive metal in the investment casting of titanium and its alloys. Applicants also envision use of the present invention for a variety of other foundry ceramic applications such as tundishes, filters, nozzles and melting crucibles.

Additional objects and advantages of the invention will be set forth in part in the description which follows, and in part will be obvious from the description, or may be learned by practice of the invention. The objects and advantages of the invention may be realized and obtained by means of instrumentalities and combinations particularly pointed out in the appended claims.

To achieve the objects and in accordance with the purpose of the invention, as embodied and broadly described herein, the invention comprises a method of using an yttria-based slurry comprising a dense grain yttria powder and a non-aqueous-based binder as a mold facecoat or corecoat in the fabrication of molds for casting reactive metals.

To further achieve the objects and in accordance with the purpose of the invention, as embodied and broadly described herein, the invention comprises a method of fabricating a casting shell for casting reactive metals comprising the steps of: preparing a pattern; dipping the pattern in an yttria-based slurry comprising a dense grain yttria powder and a non-aqueous-based binder; forming a shell on the dipped pattern; drying the shell; removing the pattern; and firing the shell.

To further achieve the objects and in accordance with the purpose of the invention, as embodied and broadly described herein, the invention comprises a method of making a casting core for fabricating a reactive metal casting comprising the steps of: forming a removable ceramic core; coating the core with an yttria-based slurry comprising a dense grain yttria powder and a non-aqueous-based binder; and firing the coated core.

The foregoing and other objects, features and advantages of the present invention will be made more apparent from the following description of the preferred embodiments.

DESCRIPTION OF THE PREFERRED EMBODIMENTS

Reference will now be made in detail to the present preferred embodiments of the invention.

In accordance with the present invention, an yttria-based slurry comprising a dense grain yttria powder and a non-aqueous-based binder is used as a mold facecoat or corecoat in the fabrication of molds for casting reactive metals. For purposes of this invention, the term reactive metals refers to metals such as titanium and titanium alloys which have a high negative free energy of formation for the oxide, nitride, carbide or sulphide of the metal or component in the metal. As embodied herein the reactive metals include, but are not limited to, titanium, titanium alloys, zirconium, zirconium alloys, aluminum-lithium alloys and alloys containing significant amounts of yttrium, lanthanum or one of the other rare earth elements.

For purposes of the present invention, the dense grain yttria powder has an apparent density greater than 4.60 grams per cubic centimeter (gm/cc) and preferably an apparent density greater than 4.90 gm/cc. The dense grain yttria powder can be formed by any number of conventional processes such as sintering, fusing, crystallizing from solution or calcining. In a preferred embodiment of the present invention, the dense grain yttria powder is a fused grain yttria powder having an apparent density of about 5.00 gm/cc. Preferably, the dense grain yttria powder comprises between about 70% and 95% by weight of the yttria-based slurry. More preferably, the dense grain yttria powder comprises between about 75% and 90% by weight of the yttria-based slurry.

For purposes of the present invention, the non-aqueous-based binder is preferably both a low temperature green strength and a high temperature ceramic binder. Preferably, the non-aqueous based binder is an organometallic which includes a metal alkoxide, chelate, or contains mixed alkoxide-chelate ligands. Preferred organometallics useful in the present invention are silicon alkoxides and titanium alkoxide-chelates. Others which might be suitable are organometallics of zirconium, aluminum, yttrium, and the rare earth elements.

In a preferred embodiment of the present invention, the non-aqueous-based binder includes the silicon alkoxide, ethyl silicate (also known as tetraethyl orthosilicate). Preferably, the silica ($SiO_2$) content of the binder is between about 4% and 18% by weight. More preferably the silica content is between about 8% and 13% by weight. Also preferably a hydrolyzed form of the ethyl silicate is used although this is not necessary, especially if the binder system readily hydrolyzes by taking up moisture from the air.

In another preferred embodiment of the present invention, the non-aqueous-based binder includes a titanium alkoxide-chelate, such as a titanium-acetylacetonate-butoxide derivative. Preferably, the titania ($TiO_2$) content of the binder is between about 4% and 30% by weight. More preferably the titania content is between about 20% and 27% by weight.

For purposes of the present invention, the non-aqueous-based binder may also include additional additives or solvents to effect other desirable characteristics, such as to adjust the silica, titania or other metal content of the non-aqueous-based binder, to catalyze the binder, to adjust the hydrolysis level of the binder, to control the drying of the binder; and/or to adjust the viscosity of the yttria-based slurry. In a preferred embodiment of the present invention wherein the non-aqueous-based binder includes ethyl silicate, the binder also includes a binder drying control additive such as propylene glycol methyl ether (also known as monopropylene glycol monomethyl ether).

In accordance with a preferred embodiment of the present invention, the yttria-based slurry, comprising a dense grain yttria powder and a tailored non-aqueous-based binder, is used to form a mold facecoat in the fabrication of an investment casting shell by the "lost wax" process. As embodied herein, a pattern made of wax, plastic or another suitable material, such as frozen mercury or wood, having the shape of the desired casting (except for allowance for an overall shrinkage factor) is prepared and dipped into the yttria-based slurry. After allowing the dipcoat layer to partially dry and/or cure, alternate layers of ceramic stucco and dipcoat or alternate dipcoat layers are applied over the original dipcoat until a shell of the desired thickness is formed. The mold is allowed to dry thoroughly, and then, via conventional techniques familiar to those skilled in the art, the pattern is removed by melting, dissolution and/or ignition. Subsequently, the mold is fired at a temperature above 1900° F., and preferably at 2050°-2400° F., for a period in excess of 0.5 hours and of preferably 1-2 hours, in an oxidizing, inert or reducing atmosphere, preferably in an air atmosphere. Prior to the casing of metal, the mold may be pre-heated to a temperature of about 200° F. or greater to ensure that the mold is effectively free of moisture. In casting, the mold is filled with molten metal with the assistance of gravity, pressure, centrifugal force, or other conventional techniques familiar to those skilled in the art. The metal is then allowed to cool. After cooling, the metal, shaped in the form of the original pattern, is removed and finished by conventional methods familiar to those skilled in the art.

In accordance with another preferred embodiment of the present invention, an yttria-based slurry, comprising a dense grain yttria powder and a non-aqueous-based binder, is employed as a corecoat in the fabrication of an investment casting core utilized in forming a hollow part of a reactive metal casting. As embodied herein, a ceramic core, preferably a siliceously bonded metal oxide core, is suitably formulated and fired. The core, in either a green (unfired) or fired state, is then coated with an yttria-based slurry comprising a dense grain yttria powder and a tailored non-aqueous-based binder. The slurry can be deposited on the surface of the core by ordinary means, such as with an aerosol spray apparatus or by dipping. Cores coated with this slurry are preferably fired at approximately 2050°–2400° F. for a period of at least 1 hour in an air atmosphere. This firing may be performed either on the as-coated core or on the investment casting mold with coated core in place; the former being the preferred method. Mold fabrication, mold pre-heat, casting, mold knockout and metal finishing are essentially the same as described above for the shell coating application. Core removal of conventional silica-based cores is accomplished by leaching techniques employing a caustic agent as the leachant or by any other appropriate method.

Preferred formulations for the yttria-based slurries used as mold facecoats and mold corecoats in accordance with the present invention are presented in Tables I and II, respectively. The yttria-based slurry used as a mold facecoat differs from the yttria-based slurry used as a mold corecoat in that the latter includes more propylene glycol methyl ether to reduce the slurry viscosity.

TABLE I

| PREFERRED FACECOAT FORMULATION | |
|---|---|
| Yttria Powder (Fused Grain, −325 mesh) | 2270 gm |
| Stauffer Silbond ® H-6 Prehydrolyzed Ethyl Silicate | 243 ml |
| Dow Chemical Dowanol ® PM (Propylene Glycol Methyl Ether) | 107 ml |

TABLE II

| PREFERRED CORE COATING FORMULATION | |
|---|---|
| Yttria Powder (Fused Grain, −325 mesh) | 2270 gm |
| Stauffer Silbond ® H-6 Prehydrolyzed Ethyl Silicate | 243 ml |
| Dow Chemical Dowanol ® PM (Propylene Glycol Methyl Ether) | 187 ml |

The Stauffer Silbond ®H-6 prehydrolyzed ethyl silicate used in the preferred formulations set forth in Tables I and II is a clear liquid having a density of 8.3 lbs./gal. at 68° F., an initial boiling point of 172° F. (78° C.) at 1 atm., a freezing point below −70° F. (−57° C.), a flash point of 76° F. (24.5° C.) by TOC, a viscosity of 7 cps. at 20° C., a color of 100 APHA max., a specific gravity of 0.985–1.005 at 15.6/15.6° C., an acidity of 0.050–0.060% max. (as HCl) and a silica content of 17.5–19.0% by wt. as $SiO_2$.

The Dow Chemical Dowanol ®PM propylene glycol methyl ether used in the preferred formulations set forth in Tables I and II is a solvent which is completely soluble in water and has a specific gravity of 0.918–0.921 at 25/25° C., an initial boiling point of 243° F. (117° C.) and a distillation point of 257° F. (125° C.) at 760 mm Hg, an acidity of 0.01 wt.% max (as acetic acid), a water content of 0.25 wt.% max., a color of 10 APHA max., a formula molecular weight of 90.1, a flash point of 89° F. (32° C.) by TCC, a refractive index of 1.404 at 68° F. (20° C.), a viscosity of 1.8 centistokes at 77° F. (25° C.), a vapor pressure of 10.9 mm Hg at 77° F. (25° C.), a freezing point of −139° F. (−95° C.), a surface tension of 26.5 dynes/cm at 77° F. (25° C.) and an evaporation rate of 66 (BuAc=100).

The utility, suitability, and advantages of the yttria-based slurry of the present invention as a mold facecoat or corecoat in the fabrication of molds for casting reactive metals is illustrated by the comparative testing described in the following examples:

EXAMPLE I

A facecoat evaluation was conducted on molds incorporating the yttria-based slurry composition of the present invention and 37 other variations for investment casting step plates of Ti-6Al-4V alloy. Wax patterns were fabricated in the form of the desired castings, with appropriate gating for molten metal feed. Individual patterns were coated with the slurry formulations listed in Table III to form the facecoat, or interior surface layer, on the mold for each pattern. On some patterns, two or three layers of the facecoat were utilized. Subsequent dipcoats on all molds were colloidal silica-bound zircon powder formulations. Stucco material between each layer of dipcoat on each mold was alumina grain. Eight layers of dipcoat/stucco were applied, followed by a cover dipcoat to minimize stucco spallation during handling. Each step plate mold was dewaxed and then fired as listed in Table III.

Prior to casting, the molds were assembled and preheated to 600° F. in air to minimize residual moisture. Under vacuum, molten Ti-6Al-4V was fed into the molds which were rotated to generate a centrifugal force for increased metal fill. After allowing the molds to cool, the shells were removed from the cast metal, and the gating was cut off. Metallographic examination of a cross-section through each step of the step plate castings revealed a 48–92% (79% average) reduction in reaction layer (alpha-case) thickness due to using the yttria-based slurry of the present invention, comprising a dense grain yttria powder and a non-aqueous-based binder (no. 38), compared to a prior art zirconia-based facecoat (no. 20). Results for each facecoat are given in Tables III and IIIA. The fused grain yttria powder used in facecoat no. 38 had a density of 5.00 gm/cc.

TABLE

FACECOAT EVALUATION - EXAMPLE I

| ID | Powder | Colloidal Binder | No. of Dips | Firing Cycle | Avg Alpha-Case Reduction vs. Baseline (%) |
|---|---|---|---|---|---|
| 20 | $ZrO_2$* | 30% $SiO_2$ | 1 | 1850° F./1h/air | Baseline |
| 1 | TiN | " | " | 1100° F./1h/Ar | 54 |

TABLE-continued

FACECOAT EVALUATION - EXAMPLE I

| ID | Powder | Colloidal Binder | No. of Dips | Firing Cycle | Avg Alpha-Case Reduction vs. Baseline (%) |
|---|---|---|---|---|---|
| 2 | " | " | " | 1700° F./1h/Ar | 54 |
| 3 | " | " | " | 1100° F./1h/Ar—5% $H_2$ | Broke-Not Tested |
| 4 | " | " | " | 1950° F./1h/Ar—5% $H_2$ | 36 |
| 5 | " | " | 2 | 1100° F./1h/Ar | 54 |
| 6 | " | " | " | 1700° F./1h/Ar | 55 |
| 7 | " | " | " | 1100° F./1h/Ar—5% $H_2$ | 67 |
| 8 | " | " | " | 1950° F./1h/Ar—5% $H_2$ | 67 |
| 9 | " | 15% $SiO_2$ | 1 | 1700° F./1h/Ar | 18 |
| 10 | " | " | " | 1950° F./1h/Ar—5% $H_2$ | 71 |
| 11 | " | " | 2 | 1700° F./1h/Ar | 58 |
| 12 | " | " | " | 1950° F./1h/Ar—5% $H_2$ | 59 |
| 13 | TiC | 30% $SiO_2$ | " | 1100° F./1h/Ar | 28 |
| 14 | " | " | " | 1950° F./1h/Ar—5% $H_2$ | 13 |
| 15 | " | 15% $SiO_2$ | " | 1700° F./1h/Ar | 26 |
| 16 | " | " | " | 1950° F./1h/Ar—5% $H_2$ | 15 |
| 17 | " | 20% $Al_2O_3$ | " | 1700° F./1h/Ar | 21 |
| 18 | " | " | " | 1950° F./1h/Ar—5% $H_2$ | 18 |
| 19 | $ZrO_2$* + 3% $TiO_2$ | 30% $SiO_2$ | 1 | 1850° F./1h/air | 4 |
| 21 | $Er_2O_3$ | " | " | 1850° F./1h/air | 32 |
| 22 | " | 20% $ZrO_2$ | " | 1850° F./1h/air | Not Testable |
| 23 | " | 14% $Y_2O_3$ | " | 1850° F./1h/air | Not Testable |
| 24 | " | 15% $SiO_2$ | 2 | 1850° F./1h/air | 46 |
| 25 | $Y_2O_3$ | 14% $Y_2O_3$ | " | 2800° F./1h/air | 56 |
| 26 | $Er_2O_3$ + 3% $TiO_2$ | 30% $SiO_2$ | 1 | 1850° F./1h/air | 7 |
| 27 | TiN + 3% $TiO_2$ | " | " | 1700° F./1h/Ar | 42 |
| 28 | $ZrO_2$*/TiN (85/15) | " | " | 1100° F./1h/Ar | 14 |
| 29 | $ZrO_2$*/$Er_2O_3$ (85/15) | 15% $SiO_2$ | " | 1850° F./1h/air | 43 |
| 30 | $ZrO_2$*/TiN (50/50) | 30% $SiO_2$ | " | 1100° F./1h/Ar | 31 |
| 31 | " | " | " | 1700° F./1h/Ar | 29 |
| 32 | $ZrO_2$*/$Er_2O_3$ (50/50) | " | " | 1850° F./1h/air | 4 |
| 33 | "Y" Paint ($Y_2O_3$) | N/A | 3 | 1850° F./1h/air | Not Testable |
| 34 | TiN | 20% $ZrO_2$ | 1 | 1100° F./1h/Ar | 54 |
| 35 | " | " | " | 1700° F./1h/Ar | 54 |
| 36 | $ZrO_2$ | " | " | 2800° F./1h/air | −18 (increase) |
| 37 | " | 30% $SiO_2$ | 2 | 1850° F./1h/vac | 20 |
| 38 | $Y_2O_3$+ | 20% $SiO_2$ Ethyl silicate | " | 1850° F./1h/air | 79 |

Average for 7 section thicknesses
*Contains 4.5 wt % CaO
+Fused grain

TABLE IIIA

FACECOAT EVALUATION - EXAMPLE I
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 20 (Base-line) | Avg. | 6.7 | 11.3 | 12.7 | 16.7 | 18.0 | 18.0 | 18.0 | |
| | Max. | 8 | 12 | 14 | 18 | 18 | 18 | 18 | |
| 1 | Avg. | 1.3 | 3.3 | 6.7 | 8.0 | 9.3 | 10.7 | 10.7 | |
| | Max. | 2 | 4 | 8 | 8 | 10 | 12 | 12 | |
| | % Red. | 81 | 71 | 47 | 52 | 48 | 41 | 41 | 54 |
| 2 | Avg. | 2.0 | 4.0 | 5.3 | 6.0 | 8.7 | 11.3 | 12.7 | |
| | Max. | 2 | 4 | 6 | 6 | 10 | 14 | 14 | |
| | % Red. | 70 | 65 | 58 | 64 | 52 | 37 | 30 | 54 |
| 4 | Avg. | 2.0 | 6.0 | 9.3 | 12.0 | 12.0 | 13.3 | 14.7 | |
| | Max. | 4 | 8 | 10 | 12 | 12 | 16 | 16 | |
| | % Red. | 70 | 47 | 27 | 28 | 33 | 26 | 18 | 36 |
| 5 | Avg. | 2.0 | 4.0 | 6.7 | 8.0 | 8.7 | 10.0 | 10.0 | |
| | Max. | 2 | 6 | 8 | 8 | 10 | 10 | 10 | |
| | % Red. | 70 | 65 | 47 | 52 | 52 | 44 | 44 | 54 |
| 6 | Avg. | 4.0 | 5.3 | 8.0 | 4.7 | 6.0 | 7.3 | 8.0 | |
| | Max. | 4 | 4 | 8 | 6 | 6 | 8 | 8 | |
| | % Red. | 40 | 53 | 37 | 72 | 67 | 59 | 56 | 55 |
| 7 | Avg. | 1.0 | 3.3 | 4.0 | 4.7 | 7.3 | 8.0 | 8.0 | |
| | Max. | 2 | 4 | 4 | 6 | 8 | 8 | 8 | |
| | % Red. | 85 | 71 | 68 | 72 | 59 | 56 | 56 | 67 |
| 8 | Avg. | 1.0 | 3.3 | 4.0 | 6.0 | 6.7 | 7.3 | 8.0 | |
| | Max. | 2 | 4 | 4 | 6 | 8 | 8 | 8 | |

TABLE IIIA-continued

FACECOAT EVALUATION - EXAMPLE I
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| | % Red. | 85 | 71 | 68 | 64 | 63 | 59 | 56 | 67 |
| 9 | Avg. | 5.3 | 8.0 | 10.7 | 13.3 | 14.0 | 16.0 | 16.7 | |
| | Max. | 6 | 10 | 12 | 14 | 16 | 18 | 18 | |
| | % Red. | 21 | 29 | 16 | 20 | 22 | 11 | 7 | 18 |
| 10 | Avg. | .5 | .5 | 4.0 | 4.7 | 7.3 | 8.0 | 8.0 | |
| | Max. | 1 | 1 | 4 | 6 | 8 | 8 | 10 | |
| | % Red. | 93 | 96 | 68 | 72 | 59 | 56 | 56 | 71 |
| 11 | Avg. | 1.0 | 4.0 | 4.7 | 6.0 | 9.3 | 10.0 | 11.3 | |
| | Max. | 2 | 4 | 6 | 6 | 10 | 10 | 12 | |
| | % Red. | 85 | 64 | 63 | 64 | 48 | 44 | 37 | 58 |
| 12 | Avg. | 3.3 | 4.0 | 4.0 | 6.0 | 6.7 | 8.7 | 9.3 | |
| | Max. | 4 | 4 | 4 | 6 | 8 | 10 | 12 | |
| | % Red. | 51 | 65 | 68 | 64 | 63 | 52 | 48 | 59 |
| 13 | Avg. | 4.7 | 7.3 | 10.0 | 12.0 | 14.0 | 13.3 | 12.7 | |
| | Max. | 6 | 8 | 10 | 12 | 14 | 14 | 14 | |
| | % Red. | 30 | 35 | 21 | 28 | 22 | 26 | 29 | 28 |
| 14 | Avg. | .6 | 10.0 | 11.3 | 13.3 | 14.7 | 16.0 | 16.0 | |
| | Max. | 8 | 12 | 12 | 14 | 16 | 16 | 16 | |
| | % Red. | 10 | 12 | 11 | 20 | 18 | 11 | 11 | 13 |
| 15 | Avg. | .2 | 7.3 | 10.7 | 12.7 | 14.0 | 15.3 | 18.0 | |
| | Max. | 2 | 10 | 12 | 14 | 14 | 16 | 22 | |
| | % | 70 | 35 | 15 | 24 | 22 | 15 | 0 | 26 |

TABLE IIIA-continued

FACECOAT EVALUATION - EXAMPLE I
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 16 | Avg. | 5.3 | 9.3 | 10.7 | 14.7 | 14.7 | 16.0 | 16.0 | |
| | Max. | 6 | 10 | 12 | 16 | 16 | 16 | 16 | |
| | % Red. | 21 | 18 | 16 | 12 | 18 | 11 | 11 | 15 |
| 17 | Avg. | 8.0 | 7.0 | 7.0 | 13 | 12 | 15 | 16 | |
| | Max. | 10 | 10 | 12 | 16 | 37 | 28 | 36 | |
| | % Red. | −19 | 38 | 45 | 22 | 33 | 17 | 11 | 21 |
| 18 | Avg. | 7.3 | 7.3 | 8.0 | 12.0 | 16.0 | 16.0 | 15.3 | |
| | Max. | 8 | 8 | 8 | 16 | 16 | 16 | 16 | |
| | % Red. | −9 | 35 | 37 | 28 | 11 | 11 | 15 | 18 |
| 19 | Avg. | 6.7 | 10.7 | 13.3 | 14.0 | 16.7 | 18.0 | 16.7 | |
| | Max. | 8 | 12 | 14 | 14 | 18 | 18 | 18 | |
| | % Red. | 0 | 5 | −5 | 16 | 7 | 0 | 7 | 4 |
| 21 | Avg. | 6.0 | 7.3 | 10.0 | 9.3 | 10.7 | 12.0 | 10.7 | |
| | Max. | 6 | 8 | 10 | 10 | 12 | 12 | 12 | |
| | % Red. | 10 | 35 | 21 | 44 | 41 | 33 | 41 | 32 |
| 24 | Avg. | 4.0 | 4.0 | 7.3 | 9.3 | 8.7 | 10.0 | 11.3 | |
| | Max. | 4 | 4 | 8 | 10 | 10 | 10 | 12 | |
| | % Red. | 40 | 65 | 42 | 44 | 52 | 44 | 37 | 46 |
| 25 | Avg. | 4.0 | 3.3 | 5.3 | 6.7 | 7.3 | 7.3 | 10.7 | |
| | Max. | 4 | 4 | 6 | 8 | 8 | 8 | 12 | |
| | % Red. | 40 | 71 | 58 | 60 | 59 | 59 | 40 | 56 |
| 26 | Avg. | 6.7 | 11.3 | 13.3 | 15.3 | 14.7 | 14.7 | 16.0 | |
| | Max. | 8 | 12 | 16 | 16 | 16 | 16 | 18 | |
| | % Red. | 0 | 0 | −5 | 8 | 18 | 18 | 11 | 7 |
| 27 | Avg. | 4.7 | 5.3 | 7.3 | 8.7 | 8.7 | 11.3 | 12.7 | |
| | Max. | 6 | 6 | 8 | 10 | 10 | 12 | 14 | |
| | % Red. | 30 | 53 | 42 | 48 | 52 | 37 | 29 | 42 |
| 28 | Avg. | 7.3 | 8.7 | 10.7 | 14.0 | 14.0 | 15.3 | 16.0 | |
| | Max. | 8 | 10 | 12 | 16 | 14 | 16 | 16 | |
| | % Red. | −9 | 23 | 16 | 16 | 22 | 15 | 11 | 14 |
| 29 | Avg. | 4.0 | 6.7 | 6.7 | 8.0 | 9.3 | 11.3 | 12.0 | |
| | Max. | 4 | 8 | 8 | 10 | 10 | 12 | 12 | |
| | % Red. | 40 | 41 | 47 | 52 | 48 | 37 | 33 | 43 |
| 30 | Avg. | 4.0 | 6.7 | 10.7 | 10.7 | 12.0 | 14.0 | 12.7 | |
| | Max. | 4 | 8 | 12 | 12 | 12 | 14 | 14 | |
| | % Red. | 40 | 41 | 16 | 36 | 33 | 22 | 29 | 31 |

TABLE IIIA-continued

FACECOAT EVALUATION - EXAMPLE I
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 31 | Avg. | 6.7 | 6.7 | 8.7 | 10.0 | 12.0 | 12.7 | 14.0 | |
| | Max. | 8 | 6 | 10 | 10 | 12 | 14 | 14 | |
| | % Red. | 0 | 41 | 32 | 40 | 33 | 33 | 22 | 29 |
| 32 | Avg. | 6.7 | 10.7 | 14.0 | 14.0 | 16.0 | 16.7 | 18.0 | |
| | Max. | 8 | 14 | 14 | 14 | 16 | 18 | 18 | |
| | % Red. | 0 | 5 | −10 | 16 | 11 | 7 | 0 | 4 |
| 34 | Avg. | .5 | 4.0 | 6.7 | 8.0 | 8.7 | 10.0 | 13.3 | |
| | Max. | 1 | 6 | 8 | 8 | 10 | 10 | 16 | |
| | % Red. | 92 | 65 | 47 | 52 | 52 | 44 | 26 | 54 |
| 35 | Avg. | 1.3 | 5.3 | 6.0 | 8.3 | 10.0 | 10.0 | 10.0 | |
| | Max. | 2 | 6 | 6 | 10 | 10 | 10 | 10 | |
| | % Red. | 81 | 53 | 53 | 50 | 44 | 44 | 52 | 54 |
| 36 | Avg. | 6.7 | 10.0 | 14.7 | 17.7 | 23.3 | 25.3 | 25.7 | |
| | Max. | 8 | 10 | 16 | 20 | 26 | 26 | 26 | |
| | % Red. | 0 | 12 | −16 | −6 | −29 | −41 | −43 | −18 |
| 37 | Avg. | 6.0 | 7.3 | 10.0 | 12.7 | 14.7 | 14.7 | 15.3 | |
| | Max. | 6 | 8 | 12 | 14 | 16 | 16 | 16 | |
| | % Red. | 10 | 35 | 21 | 24 | 18 | 18 | 15 | 20 |
| 38 | Avg. | 1.0 | 1.0 | 1.0 | 2.0 | 4.0 | 6.0 | 9.3 | |
| | Max. | 1 | 1 | 1 | 2 | 4 | 6 | 12 | |
| | % Red. | 85 | 91 | 92 | 88 | 78 | 67 | 48 | 79 |

EXAMPLE II

A second trial was performed to evaluate 26 facecoat systems, including 4 yttria-based facecoat systems of the present invention (nos. 12, 16, 17 and 18) for investment casting step plates of Ti-6Al-4V alloy. The systems tested are listed in Table IV. Systems 16, 17 and 18 used a zircon powder/ethyl silicate binder back-up dip in place of the standard zircon powder/colloidal silica bound formulation. The trial was conducted in the same manner as in Example I. Results for each facecoat are given in Tables IV and IVA. Prior art zirconia-based facecoat (no. 9) was used as a baseline. The fused grain yttria powder used in facecoat nos. 12 and 14–18 had a density of 5.00 gm/cc. The unfused grain yttria used in facecoat no. 33 had a density of 4.60 gm/cc.

TABLE IV

FACECOAT EVALUATION - EXAMPLE II

| ID | Powder | Binder* | Firing | Comments | Avg. Alpha-Case Reduction vs. Baseline (%) |
|---|---|---|---|---|---|
| 9 | $ZrO_2$ | 30% $SiO_2$ Sol | 1850° F./1 h/air | | Baseline |
| 10 | " | Ethyl Silicate | " | | −6 |
| 26 | " | 30% $SiO_2$ Sol | 1850° F./4 h/vac | | 6 |
| 31 | " | 12% $TiO_2$ Sol | 1850° F./1 h/air | | 4 |
| 1 | TiN | 30% $SiO_2$ Sol | 1100° F./1 h/Ar | | 52 |
| 2 | " | " | 1100° F./1 h/Ar—5% $H_2$ | | 49 |
| 4 | " | " | 1950° F./1 h/Ar—5% $H_2$ | | 60 |
| 5 | " | Ethyl silicate | 1100° F./1 h/Ar | | 55 |
| 6 | " | " | 1950° F./1 h/Ar—5% $H_2$ | | 59 |
| 25 | " | 30% $SiO_2$ Sol | 1100° F./1 h/Ar | Dip Pot Application | 44 |
| 32 | " | 12% $TiO_2$ Sol | " | | 38 |
| 12 | $Y_2O_3$ | Ethyl silicate | 1850° F./1 h/air | | 57 |
| 14 | " | 30% $SiO_2$ Sol | " | | 18 |
| 15 | " | " | 2700° F./1 h/air | | 4 |
| 16 | " | Ethyl silicate | 1850° F./1 h/air | $ZrSiO_4$/Et. sil. Backup | 76 |
| 17 | " | " | 2400° F./1 h/air | " | 81 |
| 18 | " | " | 2700° F./1 h/air | " | 70 |
| 33 | $Y_2O_3$** | " | 1850° F./1 h/air | | 33 |
| 27 | $ThO_2$ | " | " | | 17 |

TABLE IV-continued

FACECOAT EVALUATION - EXAMPLE II

| ID | Powder | Binder* | Firing | Comments | Avg. Alpha-Case Reduction vs. Baseline (%) |
|---|---|---|---|---|---|
| 28 | " | 15% $SiO_2$ Sol | " | | 9 |
| 29 | " | 30% $SiO_2$ Sol | " | | 15 |
| 19 | $Er_2O_3$ | " | " | | 31 |
| 21 | LaOF | " | " | | −2 |
| 22 | $CeO_2 + CeF_3$ | " | " | | −1 |
| 23 | YOF | " | " | | −7 |
| 24 | NdOF | " | " | | 8 |

Averaged over seven section thicknesses (negative value indicates increase)
*All ethylsilicate binders contain approximately 13 wt % $SiO_2$
Fused grain
**Unfused grain
All facecoats were single dip

TABLE IVA

FACECOAT EVALUATION - EXAMPLE II
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 9 (Baseline | Avg. | 3.5 | 6.6 | 9.9 | 12.8 | 14.8 | 15.6 | 16.8 | |
| | Max. | 7.2 | 11.2 | 16.0 | 16.0 | 18.0 | 18.0 | 20.0 | |
| 10 | Avg. | 3.7 | 7.3 | 11.6 | 13.3 | 15.2 | 16.4 | 16.0 | |
| | Max. | 4.6 | 8.8 | 14.0 | 16.0 | 18.0 | 19.2 | 18.0 | |
| | % Red. | −5 | −10 | −17 | −4 | −2 | −6 | 5 | −6 |
| 26 | Avg. | 2.5 | 7.0 | 9.6 | 12.0 | 14.6 | 15.4 | 14.6 | |
| | Max. | 4.0 | 10.8 | 10.8 | 16.0 | 18.0 | 20.0 | 16.0 | |
| | % Red. | 28 | −1 | 3 | 6 | 1 | 1 | 13 | 6 |
| 31 | Avg. | 4.0 | 5.5 | 8.9 | 10.4 | 15.0 | 14.6 | 18.0 | |
| | Max. | 4.0 | 6.0 | 12.0 | 14.0 | 22.0 | 18.0 | 24.0 | |
| | % Red. | −14 | 17 | 10 | 18 | −1 | 6 | −7 | 4 |
| 1 | Avg. | 1.3 | 2.3 | 4.4 | 6.0 | 8.3 | 9.5 | 8.5 | |
| | Max. | 2.4 | 4.0 | 5.6 | 6.4 | 10.0 | 12.8 | 10.0 | |
| | % Red. | 62 | 65 | 55 | 53 | 44 | 39 | 49 | 52 |
| 2 | Avg. | 1.0 | 3.4 | 4.7 | 7.5 | 7.3 | 9.3 | 10.2 | |
| | Max. | 2.0 | 4.0 | 6.4 | 9.6 | 8.0 | 10.0 | 12.0 | |
| | % Red. | 72 | 48 | 52 | 42 | 50 | 40 | 39 | 49 |
| 4 | Avg. | 1.0 | 2.6 | 4.4 | 5.6 | 6.4 | 6.1 | 7.2 | |
| | Max. | 2.0 | 4.8 | 5.2 | 8.0 | 8.8 | 6.4 | 8.4 | |
| | % Red. | 72 | 61 | 55 | 56 | 56 | 61 | 57 | 60 |
| 5 | Avg. | .7 | 2.4 | 4.8 | 6.3 | 8.4 | 8.0 | 8.4 | |
| | Max. | 2.0 | 4.0 | 6.0 | 8.0 | 10.0 | 10.0 | 10.0 | |
| | % Red. | 79 | 63 | 52 | 51 | 44 | 49 | 50 | 55 |
| 6 | Avg. | .8 | 2.0 | 4.2 | 7.0 | 7.2 | 7.2 | 6.3 | |
| | Max. | 1.6 | 3.2 | 4.4 | 8.0 | 8.0 | 8.0 | 8.0 | |
| | % Red. | 75 | 69 | 58 | 46 | 52 | 54 | 62 | 59 |
| 25 | Avg. | .7 | 2.7 | 6.2 | 8.0 | 9.9 | 12.6 | 9.9 | |
| | Max. | 2.0 | 4.0 | 8.0 | 12.0 | 12.8 | 18.0 | 12.0 | |
| | % Red. | 79 | 59 | 38 | 37 | 33 | 19 | 41 | 44 |
| 32 | Avg. | 1.3 | 4.0 | 6.2 | 7.4 | 10.3 | 11.0 | 13.3 | |
| | Max. | 3.2 | 7.2 | 8.0 | 10.0 | 12.0 | 12.0 | 24.0 | |
| | % Red. | 64 | 40 | 37 | 42 | 30 | 29 | 21 | 38 |
| 12 | Avg. | 1.7 | 2.0 | 3.0 | 5.3 | 7.8 | 8.6 | 7.0 | |
| | Max. | 4.0 | 4.0 | 7.2 | 12.0 | 14.0 | 16.0 | 10.0 | |
| | % Red. | 51 | 69 | 70 | 58 | 48 | 44 | 58 | 57 |
| 14 | Avg. | 4.1 | 6.0 | 7.2 | 9.5 | 10.3 | 12.7 | 10.6 | |
| | Max. | 8.0 | 10.0 | 12.0 | 12.0 | 12.0 | 16.4 | 12.0 | |
| | % Red. | −18 | 9 | 27 | 26 | 30 | 18 | 37 | 18 |
| 15 | Avg. | 3.9 | 7.4 | 9.9 | 12.6 | 11.6 | 14.6 | 12.3 | |
| | Max. | 6.0 | 11.2 | 14.0 | 14.0 | 12.0 | 16.0 | 14.0 | |
| | % Red. | −12 | −12 | 0 | 1 | 22 | 6 | 27 | 4 |

TABLE IVA-continued

FACECOAT EVALUATION - EXAMPLE II
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 16 | Avg. | .8 | 1.3 | 2.2 | 2.4 | 4.0 | 3.8 | 5.3 | |
| | Max. | 1.0 | 1.6 | 4.0 | 2.5 | 6.0 | 4.9 | 10.0 | |
| | % Red. | 76 | 79 | 77 | 81 | 72 | 76 | 68 | 76 |
| 17 | Avg. | .8 | 1.1 | 1.5 | 1.5 | 2.4 | 3.4 | 4.6 | |
| | Max. | 1.2 | 2.0 | 2.0 | 2.0 | 4.0 | 6.0 | 6.0 | |
| | % Red. | 75 | 83 | 84 | 88 | 84 | 78 | 72 | 81 |
| 18 | Avg. | .9 | 1.6 | 2.0 | 5.0 | 4.3 | 6.0 | 5.6 | |
| | Max. | 2.0 | 4.0 | 2.8 | 18.0 | 12.0 | 20.0 | 9.2 | |
| | % Red. | 73 | 76 | 80 | 61 | 71 | 61 | 66 | 70 |
| 33 | Avg. | 1.5 | 4.2 | 6.8 | 10.0 | 11.2 | 11.0 | 12.2 | |
| | Max. | 2.0 | 8.0 | 10.0 | 10.0 | 14.0 | 16.0 | 14.0 | |
| | % Red. | 58 | 36 | 31 | 22 | 24 | 29 | 28 | 33 |
| 27 | Avg. | 2.4 | 5.9 | 8.5 | 11.3 | 12.6 | 13.3 | 12.9 | |
| | Max. | 4.0 | 10.0 | 12.0 | 14.0 | 18.0 | 20.0 | 18.0 | |
| | % Red. | 30 | 10 | 14 | 12 | 15 | 14 | 23 | 17 |
| 28 | Avg. | 3.1 | 6.4 | 10.3 | 12.0 | 12.6 | 14.0 | 13.3 | |
| | Max. | 6.0 | 8.0 | 16.0 | 18.0 | 20.0 | 16.0 | 16.0 | |
| | % Red. | 11 | 2 | −4 | 6 | 15 | 10 | 21 | 9 |
| 29 | Avg. | 2.2 | 5.6 | 8.9 | 11.6 | 13.8 | 14.2 | 12.8 | |
| | Max. | 4.0 | 10.0 | 14.0 | 16.0 | 18.0 | 18.0 | 16.0 | |
| | % Red. | 35 | 14 | 10 | 9 | 7 | 9 | 23 | 15 |
| 19 | Avg. | 2.0 | 3.8 | 6.6 | 9.3 | 11.6 | 12.3 | 11.6 | |
| | Max. | 3.2 | 5.6 | 8.0 | 12.0 | 16.8 | 18.0 | 12.6 | |
| | % Red. | 43 | 42 | 33 | 27 | 22 | 21 | 31 | 31 |
| 21 | Avg. | 2.8 | 7.1 | 10.8 | 13.8 | 15.4 | 17.3 | 15.3 | |
| | Max. | 4.0 | 10.0 | 16.0 | 16.8 | 20.0 | 20.0 | 16.0 | |
| | % Red. | 18 | −8 | −8 | −8 | −4 | −11 | 9 | −2 |
| 22 | Avg. | 3.8 | 8.2 | 10.1 | 11.8 | 13.3 | 15.5 | 14.6 | |
| | Max. | 6.0 | 12.0 | 12.0 | 16.0 | 16.0 | 19.2 | 16.0 | |
| | % Red. | −8 | −25 | −2 | 8 | 10 | 0 | 13 | −1 |
| 23 | Avg. | 3.8 | 8.2 | 9.3 | 14.0 | 16.0 | 17.6 | 15.6 | |
| | Max. | 6.0 | 12.0 | 14.0 | 20.0 | 20.0 | 22.0 | 18.0 | |
| | % Red. | −8 | −25 | 6 | −9 | −8 | −13 | 7 | −7 |
| 24 | Avg. | 3.3 | 6.8 | 9.2 | 10.5 | 13.0 | 15.4 | 14.8 | |
| | Max. | 6.8 | 10.0 | 12.0 | 14.0 | 18.0 | 18.0 | 16.0 | |
| | % Red. | 5 | −3 | 7 | 18 | 12 | 1 | 12 | 8 |

EXAMPLE III

A third trial was performed to evaluate 23 facecoat systems, including 18 yttria-based facecoats of the present invention (facecoat nos. 2–12, 15, 17, 18, 21–23 and 33), for investment casting step plates of Ti-6Al-4V alloy. The systems tested are listed in Table V. Processing and materials modifications are noted in Table V. The trial was conducted in the same manner as in Example I. Results for each facecoat are reported in Tables V and VA. Once again a prior art zirconia-based facecoat was used as a baseline. The fused grain yttria powder used in the facecoat nos. 2–12, 15, 17, 18, 21–23 and 33 had a density of 5.00 gm/cc.

FACECOAT EVALUATION - EXAMPLE III

| ID | Powder | Binder | No. Of Dips | Firing | Comments | Avg. Alpha-Case Reduction vs. Baseline (%) |
|---|---|---|---|---|---|---|
| 1 | $ZrO_2$ | 30% $SiO_2$ Sol | 1 | 1850° F./1 h/air | | Baseline |
| 33 | $Y_2O_3$* | 4% $SiO_2$ Eth Sil | " | 2200° F./1 h/air | Varying Binder $SiO_2$ | 63 |
| 2 | " | 8% $SiO_2$ Eth Sil | " | " | " | 74 |
| 18 | " | 13% $SiO_2$ Eth Sil | " | " | " | 72 |
| 4 | " | 18% $SiO_2$ Eth Sil | " | " | " | 62 |
| 5 | " | 13% $SiO_2$ Eth Sil | " | 1850° F./ 1 h/air | Varying Firing Temp | 55 |
| 6 | " | " | " | 2000° F./1 h/air | " | 46 |
| 7 | " | " | " | 2100° F./1 h/air | " | 72 |
| 8 | " | " | " | 2300° F./1 h/air | " | 71 |
| 9 | " | " | " | 2400° F./1 h/air | " | 72 |
| 10 | " | " | " | 1850° F./1 h/air | Eth Sil Bonded Backup Dips | 50 |
| 11 | " | " | " | 2200° F./1 h/air | " | 65 |
| 12 | " | " | " | 2400° F./1 h/air | " | 60 |
| 15 | " | " | " | 2200° F./1 h/air | Air Classified (+1 micron) | 80 |
| 16 | $ZrO_2$ | 30% $SiO_2$ Sol | 2 | 1850° F./1 h/air | Double Facecoat Dips | −7 (increase) |
| 17 | $Y_2O_3$* | 8% $SiO_2$ Eth Sil | " | 2200° F./1 h/air | " | 75 |
| 3 | " | 13% $SiO_2$ Eth Sil | " | " | " | 63 |
| 20 | $ZrO_2$ | " | 1 | " | 100 w/o$ZrO_2$ | 2 |
| 21 | $ZrO_2 + Y_2O_3$* | " | " | " | 75 w/o$ZrO_2$ + 25 w/o$Y_2O_3$ | 12 |
| 22 | " | " | " | " | 50 w/o$ZrO_2$ + 50 w/o$Y_2O_3$ | 26 |
| 23 | " | " | " | " | 25 w/o$ZrO_2$ + 75 w/o$Y_2O_3$ | 44 |
| 29 | MgO | " | " | 1850° F./1 h/air | Fused Grain Powder | 21 |
| 30 | " | " | " | 2200° F./1 h/air | " | 15 |

*−325 fused grain $Y_2O_3$
Average reduction for 7 section thicknesses

TABLE VA

FACECOAT EVALUATION - EXAMPLE III
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 1 (Baseline) | Avg. | 5.8 | 9.1 | 14.3 | 15.8 | 18.5 | 18.6 | 17.4 | |
| | Max. | 7.5 | 12.5 | 16.0 | 18.0 | 22.0 | 21.0 | 19.0 | |
| 33 | Avg. | 1.5 | 2.8 | 3.5 | 6.3 | 6.5 | 7.8 | 10.0 | |
| | Max. | 3.5 | 6.5 | 6.0 | 9.0 | 9.5 | 11.5 | 12.5 | |
| | % Red. | 74 | 69 | 75 | 60 | 64 | 58 | 42 | 63 |
| 2 | Avg. | .5 | 1.0 | 2.4 | 3.8 | 5.3 | 6.5 | 9.2 | |
| | Max. | 1.0 | 1.5 | 3.0 | 4.0 | 6.5 | 9.0 | 11.5 | |
| | % Red. | 90 | 89 | 83 | 76 | 71 | 65 | 47 | 74 |
| 18 | Avg. | .8 | 2.0 | 3.5 | 5.4 | 5.3 | 6.1 | 6.5 | |
| | Max | 1.0 | 2.0 | 3.5 | 7.0 | 7.0 | 10.0 | 9.0 | |
| | % Red. | 86 | 77 | 75 | 66 | 71 | 67 | 63 | 72 |
| 4 | Avg. | 1.5 | 3.1 | 4.5 | 5.5 | 8.0 | 8.5 | 9.0 | |
| | Max. | 2.5 | 8.0 | 8.5 | 10.0 | 9.0 | 13.0 | 12.5 | |
| | % Red. | 73 | 65 | 69 | 65 | 57 | 54 | 48 | 62 |
| 5 | Avg. | 2.2 | 4.3 | 5.2 | 7.1 | 7.9 | 8.9 | 9.8 | |
| | Max. | 6.5 | 8.0 | 9.0 | 11.5 | 11.5 | 12.5 | 14.0 | |
| | % Red. | 61 | 53 | 64 | 55 | 57 | 52 | 44 | 55 |
| 6 | Avg. | 2.6 | 4.5 | 8.0 | 9.9 | 10.0 | 9.3 | 10.8 | |
| | Max. | 6.0 | 7.0 | 11.0 | 11.5 | 12.0 | 13.0 | 15.0 | |
| | % Red. | 54 | 51 | 44 | 37 | 46 | 50 | 38 | 46 |
| 7 | Avg. | .9 | 1.8 | 4.0 | 4.7 | 4.0 | 5.0 | 8.8 | |
| | Max. | 2.0 | 3.5 | 7.0 | 7.0 | 7.5 | 7.0 | 10.0 | |
| | % Red. | 84 | 80 | 72 | 70 | 78 | 73 | 49 | 72 |

TABLE VA-continued

FACECOAT EVALUATION - EXAMPLE III
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 8 | Avg. | 1.3 | 2.4 | 3.5 | 4.5 | 4.5 | 4.3 | 8.6 | |
| | Max. | 2.5 | 4.0 | 5.0 | 6.0 | 6.5 | 7.0 | 11.5 | |
| | % Red. | 77 | 74 | 75 | 71 | 75 | 77 | 50 | 71 |
| 9 | Avg. | 1.2 | 2.2 | 3.5 | 4.0 | 4.9 | 5.8 | 7.2 | |
| | Max. | 3.0 | 3.5 | 5.0 | 6.0 | 7.5 | 8.5 | 8.5 | |
| | % Red. | 78 | 75 | 75 | 74 | 73 | 69 | 58 | 72 |
| 10 | Avg. | 3.4 | 4.6 | 7.0 | 7.9 | 8.6 | 9.3 | 8.3 | |
| | Max. | 8.0 | 9.0 | 11.5 | 12.0 | 18.0 | 16.0 | 12.0 | |
| | % Red. | 41 | 49 | 51 | 50 | 53 | 50 | 52 | 50 |
| 11 | Avg. | 1.0 | 2.9 | 5.4 | 7.0 | 7.5 | 6.6 | 6.5 | |
| | Max. | 1.5 | 8.0 | 8.0 | 14.5 | 12.5 | 11.0 | 9.0 | |
| | % Red. | 82 | 68 | 62 | 56 | 60 | 64 | 62 | 65 |
| 12 | Avg. | 1.3 | 2.5 | 5.1 | 7.2 | 9.3 | 8.3 | 9.5 | |
| | Max. | 4.5 | 5.0 | 9.0 | 9.5 | 14.0 | 11.0 | 11.5 | |
| | % Red. | 77 | 72 | 64 | 54 | 50 | 55 | 45 | 60 |
| 15 | Avg. | .6 | 1.6 | 3.3 | 3.1 | 4.0 | 3.7 | 5.3 | |
| | Max. | 1.0 | 2.5 | 4.5 | 4.0 | 5.5 | 5.0 | 6.0 | |
| | % Red. | 88 | 83 | 77 | 80 | 78 | 80 | 69 | 80 |
| 16 | Avg. | 5.8 | 10.4 | 14.7 | 17.4 | 19.0 | 20.7 | 18.9 | |
| | Max. | 8.5 | 12.5 | 17.5 | 22.0 | 24.0 | 23.0 | 21.0 | |
| | % Red. | −1 | −14 | −3 | −10 | −3 | −11 | −9 | −7 |
| 17 | Avg. | .4 | 1.0 | 2.8 | 3.9 | 4.6 | 5.7 | 9.1 | |
| | Max. | .5 | 2.0 | 3.5 | 5.0 | 6.0 | 8.0 | 11.5 | |
| | % Red. | 93 | 88 | 80 | 75 | 75 | 69 | 47 | 75 |
| 3 | Avg. | 1.0 | 2.7 | 4.4 | 4.7 | 6.5 | 10.0 | 10.9 | |
| | Max. | 2.5 | 5.5 | 8.0 | 7.0 | 8.0 | 15.0 | 13.0 | |
| | % Red. | 81 | 70 | 69 | 70 | 65 | 46 | 37 | 63 |
| 20 | Avg. | 5.1 | 8.9 | 12.3 | 16.2 | 19.1 | 18.3 | 18.8 | |
| | Max. | 7.5 | 11.5 | 15.0 | 19.0 | 22.0 | 20.0 | 19.7 | |
| | % Red. | 11 | 3 | 14 | −3 | −4 | 2 | −8 | 2 |
| 21 | Avg. | 6.0 | 8.1 | 11.5 | 13.8 | 16.1 | 16.5 | 14.7 | |
| | Max. | 7.0 | 11.0 | 15.0 | 17.0 | 18.0 | 18.0 | 15.0 | |

TABLE VA-continued

FACECOAT EVALUATION - EXAMPLE III
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| | % Red. | −3 | 11 | 20 | 13 | 13 | 12 | 16 | 12 |
| 22 | Avg. | 4.8 | 7.3 | 8.5 | 11.7 | 13.1 | 14.2 | 13.0 | |
| | Max. | 6.0 | 8.5 | 11.0 | 15.0 | 14.5 | 20.0 | 15.5 | |
| | % Red. | 17 | 20 | 40 | 26 | 29 | 24 | 25 | 26 |
| 23 | Avg. | 3.0 | 4.9 | 6.6 | 9.3 | 10.0 | 11.2 | 11.0 | |
| | Max. | 5.0 | 6.0 | 9.0 | 12.5 | 11.5 | 14.0 | 15.0 | |
| | % Red. | 48 | 46 | 53 | 41 | 46 | 40 | 36 | 44 |
| 29 | Avg. | 4.2 | 7.4 | 9.4 | 12.6 | 13.5 | 15.0 | 17.5 | |
| | Max. | 6.0 | 11.0 | 11.5 | 16.0 | 16.0 | 16.0 | 23.0 | |
| | % Red. | 27 | 19 | 34 | 20 | 27 | 20 | 0 | 21 |
| 30 | Avg. | 4.5 | 8.7 | 11.5 | 14.5 | 14.5 | 16.5 | 14.1 | |
| | Max. | 7.0 | 11.0 | 14.0 | 17.5 | 16.0 | 19.0 | 16.0 | |
| | % Red. | 23 | 4 | 19 | 8 | 22 | 11 | 19 | 15 |

EXAMPLE IV

A fourth trial was performed wherein 17 hollow step wedges were cast in Ti-6Al-4V. The systems tested, along with materials and process configurations, are listed in Table VI. The systems tested included 8 yttria-based corecoats of the present invention (corecoat nos. 6–13). After each core was coated, (and fired, if indicated), each core was incorporated into a step wedge wax pattern. The wax patterns subsequently were incorporated into individual shells, utilizing the prior art zirconia powder/colloidal silica binder facecoat for all specimens. The remainder of the trial was conducted in the same manner as Example I. Results for each core/corecoating system are given in Tables VI and VIA. Again a prior art zirconia-based corecoat was used as a baseline. The yttria used in the corecoat nos. 6–13 and 22 was fused grain yttria powder having a density of 5.00 gm/cc.

TABLE VI

CORE COATING EVALUATION - EXAMPLE IV

| ID | Core Coating++ | Coating Application | Coating Fire | Mold Fire | Avg. Alpha-Case Reduction vs. Baseline (%)* |
|---|---|---|---|---|---|
| 2 | $ZrO_2$/30% $SiO_2$ sol | PS | 1850° F./1 h/air | 1850° F./1 h/air | Baseline |
| 4 | $ZrO_2$ | CVD | None | " | −14 |
| 5 | $HfO_2$ | " | " | " | 12 |
| 6 | $Y_2O_3$/eth sil | Dipping | 1850° F./1 h/air | " | 87 |
| 7 | " | PS | " | " | 55 |
| 8 | " | " | 2050° F./1 h/air | " | 89 |
| 9 | " | " | 2250° F./1 h/air | " | 91 |
| 10 | " | " | 2450° F./1 h/air | " | 86 |
| 11 | " | PS (2 coats) | 2250° F./1 h/air | " | 87 |
| 12 | " | PS | " | 2250° F./1 h/air | 34 |
| 13 | " | " | None | " | 70 |
| 14 | TiN/30% $SiO_2$ sol | Dipping | 1850° F./1 h/Ar—5% $H_2$ | 1850° F./1 h/Ar—5% $H_2$ | 33 |
| 15 | " | PS | " | " | 22 |
| 17 | $Nd_2O_3$/eth sil | Dipping | 2250° F./1 h/air | 1850° F./1 h/air | −31 |
| 18 | MgO/eth sil | " | " | " | 2 |
| 22 | $Y_2O_3$ | APS | " | " | 98 |
| 23 | $ZrO_2$—7w/o$Y_2O_3$ | " | " | " | 28 |

*Average for 7 section thicknesses (Negative value indicates alpha-case increase)
PS: Aerosol spray
CVD: Chemical Vapor Deposition
APS: Air Plasma Spray
++All ethyl silicate binders contain approximately 13 wt % $siO_2$

TABLE VIA

CORE COATING EVALUATION - EXAMPLE IV
ALPHA-CASE DEPTHS (MILS)
AND AVG. ALPHA-CASE REDUCTIONS (%)

| ID | | Section Thickness 1/16" | 1/8" | 1/4" | 3/8" | 1/2" | 5/8" | 3/4" | 7/8" | Avg. |
|---|---|---|---|---|---|---|---|---|---|---|
| 2 | Avg. | 2.6 | 5.3 | 9.1 | 12.0 | 13.8 | 14.8 | 15.0 | 15.8 | |
| (Baseline) | Max. | 5.0 | 6.0 | 12.0 | 16.0 | 17.0 | 17.0 | 17.0 | 19.0 | |
| 4 | Avg. | 3.0 | 5.8 | 11.0 | 13.5 | 15.1 | 16.5 | 18.0 | 19.3 | |
| | Max. | 4.0 | 6.0 | 12.0 | 15.0 | 16.0 | 17.0 | 19.0 | 20.0 | |
| | % Red. | −13 | −9 | −16 | −12 | −10 | −11 | −20 | −22 | −14 |
| 5 | Avg. | 1.6 | 4.1 | 7.6 | 11.0 | 13.0 | 13.8 | 14.8 | 16.1 | |
| | Max. | 4.0 | 6.0 | 10.0 | 13.0 | 14.0 | 17.0 | 17.0 | 17.0 | |
| | % Red. | 37 | 22 | 16 | 8 | 6 | 7 | 1 | −2 | 12 |
| 6 | Avg. | 0.0 | 0.6 | 0.5 | 1.5 | 2.8 | 2.1 | 2.5 | 2.6 | |
| | Max. | 0.0 | 2.0 | 2.0 | 3.0 | 6.0 | 6.0 | 6.0 | 6.0 | |
| | % Red. | 100 | 87 | 94 | 87 | 80 | 85 | 83 | 83 | 87 |
| 7 | Avg. | 1.6 | 0.8 | 1.6 | 3.3 | 7.0 | 8.3 | 9.0 | 10.5 | |
| | Max. | 3.0 | 1.0 | 2.0 | 5.0 | 11.0 | 13.0 | 14.0 | 13.0 | |
| | % Red. | 37 | 84 | 82 | 72 | 49 | 44 | 40 | 34 | 55 |
| 8 | Avg. | 0.8 | 0.5 | 0.5 | 0.8 | 1.3 | 1.1 | 1.0 | 1.2 | |
| | Max. | 3.0 | 1.0 | 1.0 | 1.0 | 2.0 | 2.0 | 1.0 | 2.0 | |
| | % Red. | 69 | 91 | 94 | 93 | 90 | 92 | 93 | 92 | 89 |
| 9 | Avg. | 0.5 | 0.5 | 0.5 | 0.6 | 1.1 | 1.1 | 0.8 | 1.6 | |

TABLE VIA-continued

CORE COATING EVALUATION - EXAMPLE IV
ALPHA-CASE DEPTHS (MILS)
AND AVG. ALPHA-CASE REDUCTIONS (%)

| ID | | Section Thickness 1/16" | 1/8" | 1/4" | 3/8" | 1/2" | 5/8" | 3/4" | 7/8" | Avg. |
|---|---|---|---|---|---|---|---|---|---|---|
| | Max. | 1.0 | 1.0 | 1.0 | 2.0 | 4.0 | 4.0 | 2.0 | 4.0 | |
| | % Red. | 81 | 91 | 94 | 94 | 92 | 92 | 94 | 90 | 91 |
| 10 | Avg. | 0.0 | 0.0 | 0.5 | 2.0 | 2.0 | 1.5 | 2.0 | 8.0 | |
| | Max. | 0.0 | 0.0 | 1.0 | 4.0 | 3.0 | 2.0 | 3.0 | 20.0 | |
| | % Red. | 100 | 100 | 94 | 83 | 86 | 90 | 87 | 49 | 86 |
| 11 | Avg. | 0.0 | 0.5 | 1.1 | 2.0 | 2.0 | 2.1 | 1.6 | 3.7 | |
| | Max. | 0.0 | 1.0 | 2.0 | 4.0 | 3.0 | 5.0 | 2.0 | 5.0 | |
| | % Red. | 100 | 91 | 87 | 83 | 86 | 85 | 89 | 77 | 87 |
| 12 | Avg. | 2.1 | 3.1 | 4.1 | 7.0 | 7.1 | 9.8 | 10.0 | 15.1 | |
| | Max. | 3.0 | 4.0 | 7.0 | 14.0 | 10.0 | 12.0 | 12.0 | 19.0 | |
| | % Red. | 19 | 41 | 54 | 41 | 48 | 34 | 33 | 4 | 34 |
| 13 | Avg. | 0.8 | 0.8 | 1.0 | 2.5 | 4.5 | 5.8 | 5.1 | 8.8 | |
| | Max. | 2.0 | 2.0 | 2.0 | 4.0 | 7.0 | 9.0 | 9.0 | 15.0 | |
| | % Red. | 69 | 84 | 89 | 79 | 67 | 61 | 66 | 44 | 70 |
| 14 | Avg. | 3.1 | 2.6 | 4.8 | 7.0 | 8.6 | 8.8 | 10.3 | 10.3 | |
| | Max. | 5.0 | 4.0 | 7.0 | 8.0 | 10.0 | 10.0 | 14.0 | 12.0 | |
| | % Red. | −18 | 50 | 47 | 42 | 37 | 40 | 31 | 35 | 33 |
| 15 | Avg. | 1.6 | 5.0 | 7.5 | 9.2 | 9.6 | 11.6 | 11.0 | 13.3 | |
| | Max. | 3.0 | 7.0 | 10.0 | 12.0 | 10.0 | 13.0 | 13.0 | 15.0 | |
| | % Red. | 37 | 6 | 18 | 24 | 30 | 21 | 27 | 16 | 22 |
| 17 | Avg. | 5.0 | 7.5 | 11.3 | 14.5 | 15.1 | 17.1 | 19.1 | 19.0 | |
| | Max. | 6.0 | 9.0 | 12.0 | 16.0 | 16.0 | 19.0 | 22.0 | 21.0 | |
| | % Red. | −88 | −42 | −24 | −21 | −10 | −16 | −28 | −20 | −31 |
| 18 | Avg. | 2.5 | 9.5 | 8.0 | 10.5 | 11.8 | 11.0 | 12.0 | 15.0 | |
| | Max. | 3.0 | 18.0 | 12.0 | 12.0 | 13.0 | 13.0 | 14.0 | 18.0 | |
| | % Red. | 4 | −78 | 13 | 12 | 14 | 26 | 19 | 5 | 2 |
| 22 | Avg. | 0.0 | 0.0 | 0.0 | 0.5 | 1.5 | 0.3 | 0.0 | 0.0 | |
| | Max. | 0.0 | 0.0 | 0.0 | 2.0 | 5.0 | 2.0 | 0.0 | 0.0 | |
| | % Red. | 100 | 100 | 100 | 96 | 89 | 98 | 100 | 100 | 98 |
| 23 | Avg. | 2.8 | 5.3 | 7.6 | 7.3 | 7.8 | 3.3 | 9.5 | 13.3 | |
| | Max. | 5.0 | 9.0 | 9.0 | 11.0 | 10.0 | 12.0 | 15.0 | 16.0 | |
| | % Red. | −6 | 0 | 16 | 39 | 43 | 78 | 37 | 16 | 28 |

EXAMPLE V

A fifth trial was performed wherein five hollow step wedges were cast. The systems tested, along with materials and process configurations, are listed in Table VII. The systems tested included three yttria-based core-coats of the present invention (corecoat nos. 2, 13, 20). The trial was conducted in the same manner as Example IV. Results for each core/corecoat system are given in Tables VII and VIIA. Again a prior art zirconia-based corecoat was used as a baseline. The yttria used in the corecoat nos. 2 and 13 was fused grain yttria powder having a density of 5.00 gm/cc. The yttria used in the corecoat no. 20 was a nonfused, highly calcined, large grain size yttria powder having a density of 5.00 gm/cc. The Ti-ester binder used in corecoat nos. 13 and 22 was specifically Titanate Binder LPC 3851/1, a titanium-acetylacetonate-butoxide derivative manufactured by Dynamit Nobel (distributed by Dynamit Nobel of America, Inc., Kay-Fries, Inc., Chemical Division).

The core coating formulation used in corecoat no. 13 was as follows:

Yttria Powder (Fused Grain, −325 mesh): 260 gm,
Titanate Binder LPC 3851/1: 60 ml,
Dow Chemical DOWANOL ®PM (propylene glycol methyl ether): 15 ml.

TABLE VII

CORE COATING EVALUATION - EXAMPLE V

| ID | Core Coating | Coating Fire | Avg. Alpha-Case Reduction Vs. Baseline (%)* |
|---|---|---|---|
| 1 | Fused $ZrO_2$/30% $SiO_2$ Sol | 1850° F./1 hr/air | Baseline |
| 2 | Fused $Y_2O_3$/Ethylsilicate (13% $SiO_2$) | 2050° F./1 hr/air | 97 |
| 13 | Fused $Y_2O_3$/Ti-ester (26% $TiO_2$) | 2250° F./2 hr/air | 97 |
| 20 | Nonfused, Dense $Y_2O_3$/Et. Sil. (13% $SiO_2$) | 2050° F./1 hr/air | 97 |
| 22 | Fused $ZrO_2$/Ti-ester (26% $TiO_2$) | 2250° F./2 hr/air | 6 |

Ti-ester Binder = Titanate Binder LPC 3851/1
All coatings applied by aerosol spray
All molds were fired 1850° F./1 hr/air
*Average for 7 section thicknesses

TABLE VII

CORE COATING EVALUATION - EXAMPLE V
ALPHA-CASE DEPTHS (MILS)
AND AVG. ALPHA-CASE REDUCTIONS (%)

| ID | | Section Thickness 1/8" | 1/4" | 3/8" | 1/2" | 5/8" | 3/4" | 7/8" | Avg. |
|---|---|---|---|---|---|---|---|---|---|
| 1 | Avg | 6.3 | 10.9 | 13.1 | 15.6 | 17.1 | 19.1 | 21.3 | |
| (Base- | Max | 8.0 | 12.9 | 15.3 | 18.0 | 19.3 | 24.7 | 25.3 | |
| line | | | | | | | | | |
| 2 | Avg | 0 | 0 | 0.1 | 0.4 | 0.5 | 1.2 | 1.6 | |
| | Max | 0 | 0 | 0.3 | 1.3 | 0.8 | 1.7 | 2.4 | |
| | % Red. | 100 | 100 | 99 | 97 | 97 | 94 | 92 | 97 |
| 13 | Avg | 0 | 0 | 0 | 0.1 | 0.5 | 1.1 | 2.0 | |
| | Max | 0 | 0 | 0 | 0.3 | 1.3 | 1.9 | 2.8 | |

TABLE VII-continued

CORE COATING EVALUATION - EXAMPLE V
ALPHA-CASE DEPTHS (MILS)
AND AVG. ALPHA-CASE REDUCTIONS (%)

| ID | | Section Thickness | | | | | | | |
|---|---|---|---|---|---|---|---|---|---|
| | | 1/8" | 1/4" | 3/8" | 1/2" | 5/8" | 3/4" | 7/8" | Avg. |
| | % Red. | 100 | 100 | 100 | 99 | 97 | 94 | 91 | 97 |
| 20 | Avg | 0 | 0 | 0.1 | 0.8 | 0.6 | 0.8 | 1.4 | |
| | Max | 0 | 0 | 0.5 | 3.0 | 1.8 | 1.1 | 1.9 | |
| | % Red. | 100 | 100 | 99 | 95 | 96 | 96 | 93 | 97 |
| 22 | Avg | 6.0 | 10.2 | 12.4 | 14.2 | 16.2 | 17.5 | 20.0 | |
| | Max | 8.0 | 13.7 | 15.7 | 16.7 | 20.7 | 20.0 | 22.7 | |
| | % Red. | 5 | 6 | 5 | 9 | 5 | 8 | 6 | 6 |

It will be apparent to those skilled in the art that various modifications and variations can be made in the present invention without departing from the scope or spirit of the invention. Thus, it is intended that the present invention cover the modifications and variations of this invention provided that they come within the scope of the appended claims and their equivalents.

What is claimed is:

1. A method of fabricating molds for casting reactive metals comprising the steps of: preparing an yttria-based slurry comprising a dense grain yttria powder having a density greater than 4.60 gm/cc and a non-aqueous-based binder; and using said slurry as a mold facecoat or corecoat in the fabrication of a mold for casting a reactive metal.

2. The method of claim 1 wherein said yttria powder has a density greater than 4.90 gm/cc.

3. The method of claim 2 wherein said yttria powder is a fused grain yttria powder having a density of about 5.00 gm/cc.

4. The method of claim 1 wherein said non-aqueous-based binder includes an organometallic compound containing one or more metals selected from the group of silicon, titanium, zirconium, aluminum and the rare earth elements.

5. The method of claim 4 wherein said organometallic compound is a metal alkoxide, a chelate or contains mixed alkoxide-chelate ligands.

6. The method of claim 5 wherein said organometallic compound is ethyl silicate.

7. The method of claim 5 wherein said organometallic compound is a titanium-acetylacetonate-butoxide derivative.

8. The method of claim 1 wherein said non-aqueous-based-binder includes a drying control additive.

9. The method of claim 1 wherein said yttria powder is a fused grain yttria powder and said non-aqueous-based binder comprises ethyl silicate and propylene glycol methyl ether.

10. The method of claim 1 wherein said mold is for casting a gas turbine engine component.

11. The method of claim 1 wherein said mold is for casting a surgical implant.

12. The method of claim 1 wherein said mold is for casting a chemical resistant component.

13. A method of making a casting shell for fabricating a reactive metal casting comprising the steps of:

preparing a pattern;

dipping said pattern in an yttria-based slurry comprising a dense grain yttria powder having a density greater than 4.60 gm/cc and a non-aqueous-based binder;

forming a shell on said dipped pattern;

drying said shell;

removing said pattern; and firing said shell.

14. The reactive metal casting made from the casting shell made by the method of claim 13.

15. The reactive metal casting of claim 14 wherein said reactive metal is a titanium alloy.

16. The reactive metal casting of claim 14 wherein said casting is a gas turbine engine component.

17. The reactive metal casting of claim 14 wherein said casting is a surgical implant.

18. The reactive metal casting of claim 14 wherein said casting is a chemical resistant component.

19. A method of making a casting core for fabricating a reactive metal casting comprises the steps of:

forming a removable ceramic core;

coating said core with an yttria-based slurry comprising a dense grain yttria powder having a density greater than 4.60 gm/cc and a non-aqueous-based binder; and firing said coated core.

20. The reactive metal casting made with the casting core made by the method of claim 19.

21. The reactive metal casting of claim 20 wherein said reactive metal is a titanium alloy.

22. The reactive metal casting of claim 20 wherein said casting is a gas turbine engine component.

23. The reactive metal casting of claim 20 wherein said casting is a surgical implant.

24. The reactive metal casting of claim 20 wherein said casting is a chemical resistant component.

* * * * *